United States Patent [19]

Itou et al.

[11] Patent Number: 4,495,112

[45] Date of Patent: Jan. 22, 1985

[54] VARIABLE VENTURI-TYPE CARBURETOR

[75] Inventors: Takaaki Itou; Takashi Katou, both of Mishima; Toshiharu Morino, Susono, all of Japan

[73] Assignees: Toyota Jidosha Kabushiki Kaisha, Toyota; Aisan Industry Co., Ltd., Obu, both of Japan

[21] Appl. No.: 437,142

[22] Filed: Oct. 27, 1982

[30] Foreign Application Priority Data

Jun. 22, 1982 [JP] Japan ..... 57-106134

[51] Int. Cl.[3] ..... F02M 9/06

[52] U.S. Cl. ..... 261/41 D; 261/44 C

[58] Field of Search ..... 261/44 C, 41 D

[56] References Cited

U.S. PATENT DOCUMENTS

| | | | |
|---|---|---|---|
| 2,852,240 | 9/1958 | Goodyear | 261/41 D |
| 3,753,555 | 8/1973 | Lawrence | 261/44 C |
| 3,765,658 | 10/1973 | Hartel et al. | 261/44 C |
| 4,330,489 | 5/1982 | Ito et al. | 261/44 C |
| 4,371,478 | 2/1983 | Wada | 261/44 C |
| 4,394,331 | 7/1983 | Okabe et al. | 261/44 C |

FOREIGN PATENT DOCUMENTS

| | | | |
|---|---|---|---|
| 1246560 | 9/1971 | United Kingdom | 261/41 D |

*Primary Examiner*—Tim Miles

*Attorney, Agent, or Firm*—Finnegan, Henderson, Farabow, Garrett & Dunner

[57] ABSTRACT

A variable venturi-type carburetor comprising a main fuel passage, a slow fuel port and a slow fuel passage connecting the main fuel passage to the slow fuel passage. A fuel metering jet is arranged in the slow fuel passage. The slow fuel passage, between the fuel metering jet and the slow fuel port, is connected to the venturi portion of the carburetor via a jet.

10 Claims, 1 Drawing Figure

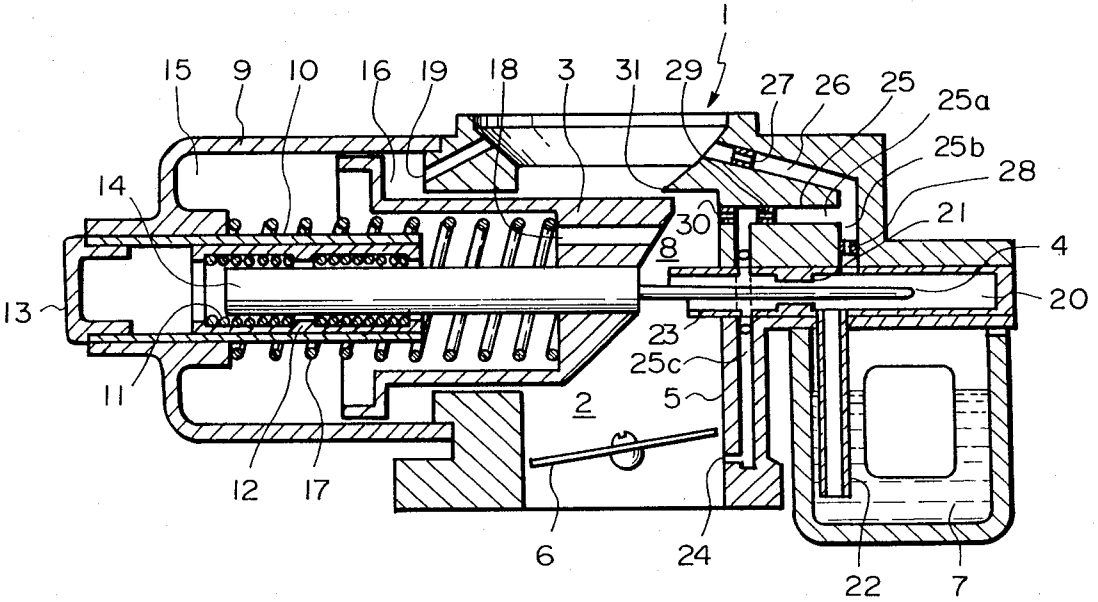
1
2
3
4
5
6
7
8
9
10
11
12
13
14
15
16
17
18
19
20
21
22
23
24
25
25a
25b
25c
26
27
28
29
30
31

VARIABLE VENTURI-TYPE CARBURETOR

BACKGROUND OF THE INVENTION

The present invention relates to a variable venturi-type carburetor.

A variable venturi-type carburetor normally comprises a suction piston, a needle supported by the suction piston, a fuel passage extending in the axial direction of the needle so that the needle is able to enter into the fuel passage, and a metering jet situated in the fuel passage and interacting with the needle. The fuel passage, located upstream of the metering jet, is connected to the float chamber of the carburetor. In order to obtain stable engine idling, the conventional variable venturi-type carburetor has a slow fuel system comprised of a slow fuel port continuously open to the intake passage located downstream of the throttle valve of the carburetor, a slow fuel passage branched off from the fuel passage upstream of the metering jet and connected to the slow fuel port, and a slow fuel jet situated in the slow fuel passage. In this slow fuel system, a vacuum, produced in the intake passage, acts on the slow fuel passage via the slow fuel port. Fuel in the fuel passage is sucked into the slow fuel passage via the slow fuel jet by this vacuum and fed into the intake passage from the slow fuel port. However, in a conventional variable venturi-type carburetor, if the throttle valve is abruptly opened to accelerate the engine, since the level of the vacuum acting on the slow fuel port abruptly becomes small, the level of the vacuum in the slow fuel passage also drops abruptly, and thus the amount of fuel sucked into the slow fuel passage from the fuel passage is abruptly reduced. As a result, since the amount of fuel fed into the intake passage from the slow fuel port is reduced, the fuel mixture fed into the cylinder of the engine becomes lean, and thus problems occur in that it is impossible to obtain good engine acceleration, and that the exhaust emission quality will deteriorate.

SUMMARY OF THE INVENTION

An object of the present invention is to provide a variable venturi-type carburetor capable of providing good engine acceleration and an acceptable level of exhaust emissions.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

According to the present invention, there is provided a variable venturi-type carburetor comprising: an intake passage formed in the carburetor and having an inner wall; a suction piston transversely movable in said intake passage in response to a change in the amount of air flowing within said intake passage, said suction piston having a tip face which defines a venturi portion in said intake passage; a throttle valve arranged in said intake passage at a position downstream of said suction piston; a main fuel passage transversely extending and opening into said intake passage; a metering jet arranged in said main fuel passage; a needle fixed onto the tip face of said suction piston and extending through said main fuel passage and said metering jet; a slow fuel port formed on the inner wall of said intake passage and opening into said intake passage located downstream of said throttle valve; a slow fuel passage interconnecting said slow fuel port to said main fuel passage upstream of said metering jet; a first fuel metering jet arranged in said slow fuel passage; and a vacuum control jet interconnecting said venturi portion to said slow fuel passage between said slow fuel port and said first fuel metering jet.

The present invention may be more fully understood from the description of a preferred embodiment of the invention set forth below, together with the accompanying drawing.

BRIEF DESCRIPTION OF THE DRAWING

The sole FIGURE is a cross-sectional side view of a variable venturi-type carburetor constructed according to the present invention.

DESCRIPTION OF A PREFERRED EMBODIMENT

Referring to the FIGURE, numeral 1 designates the carburetor body, 2 a vertically extending intake passage, 3 a suction piston transversely movable in the intake passage 2, and 4 a needle fixed onto the tip face of the suction piston 3. Numeral 5 designates the inner wall of the intake passage 2, 6 a throttle valve arranged in the intake passage 2 located downstream of the suction piston 3, and 7 a float chamber of the carburetor. A venturi portion 8 is formed between the inner wall 5 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. On the other end, a guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof.

The interior of the casing 9 is divided into a vacuum chamber 15 and an atmospheric pressure chamber 16 by the suction piston 3, and a compression spring 17 for continuously biasing the suction piston 3 towards the venturi portion 8 is mounted in the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

A fuel passage 20 is formed in the carburetor body 1 and extends in the axial direction of the needle 4 so that the needle 4 can enter into the fuel passage 20. A metering jet 21 is arranged in the fuel passage 20. The fuel passage 20, at a point upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the inner wall 5 of the intake passage 2. The nozzle 23 projects from the inner wall of the inner wall 5 into the venturi portion 8 and, in addition, the upper half of the tip portion of the nozzle 23 projects beyond the lower half of the tip portion of the nozzle 23 towards the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

As illustrated in the FIGURE, a slow fuel port 24 is formed on the inner wall 5 of the intake passage 2 located downstream of the throttle valve 6, and the slow fuel port 24 is connected via a slow fuel passage 25 to the fuel passage 20 upstream of the metering jet 21. The slow fuel passage 25 comprises a horizontally extending intermediate passage portion 25*a*, an inlet passage portion 25*b* extending downwards from one end of the intermediate passage portion 25*a* and open to the fuel passage 20, and an outlet passage portion 25*c* extending downward from the other end of the intermediate passage portion 25*a* and connected to the slow fuel port 24. The connecting portion of the inlet passage portion 25*b* and the intermediate passage portion 25*a* is connected via an air bleed passage 26 to the intake passage 2 located upstream of the suction piston 3, and an air bleed jet 27 is inserted into the air bleed passage 26. In addition, a first slow fuel jet 28 is arranged in the inlet passage portion 25*b*, and a second slow fuel jet 29 is arranged in the intermediate passage portion 25*a*. Furthermore, the connecting portion of the intermediate passage portion 25*a* and the outlet passage portion 25*b* are connected to the venturi portion 8 via a jet 30. The jet 30 has an opening area larger than that of the second slow fuel jet 29, and the second slow fuel jet 29 has an opening area larger than the slow fuel port 24. In addition, the slow fuel port 24 has an opening area larger than the first slow fuel jet 28.

As illustrated in the FIGURE, a raised wall 31, projecting horizontally into the intake passage 2, is formed on the inner wall 5 of the intake passage 2, located upstream of and adjacent to the suction piston 3, and flow control is effected between the raised wall 31 and the tip end portion of the suction piston 3. When the engine is started, air flows downwards within the intake passage 2. At this time, since the air flow is restricted between the suction piston 3 and the raised wall 31, a vacuum is created in the venturi 8. This vacuum acts on vacuum chamber 15 via suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant. As will be understood from the FIGURE, the jet 30 is arranged on the inner wall 5 of the intake passage 2 at a position located extremely near the raised wall 31.

In operation, a portion of the fuel is fed into the intake passage 2 from the nozzle 23 via the metering jet 21, and the remaining fuel is fed into the intake passage 2 from the slow fuel port 24 via the slow fuel passage 25. The fuel, flowing within the slow fuel passage 25, is initially metered by the first slow fuel jet 28, and then flows into the intermediate passage portion 25*a*. At this time, air is bled into the fuel from the air bleed passage 26. The fuel, containing air bubbles therein, then flows within the second slow fuel jet 29 and flows into the outlet passage portion 25*c* due to the pressure difference between the vacuum in the outlet passage portion 25*c* and the vacuum in the intermediate passage portion 25*a* located upstream of the second slow fuel jet 29. The fuel, containing air bubbles therein, is then fed into the intake passage 2 via the slow fuel port 24.

As mentioned above, the jet 30 has an opening area larger than slow fuel port 24. Consequently, the vacuum in the outlet passage portion 25*c* is altered, depending upon the vacuum acting on the jet 30, that is, depending upon the vacuum in the venturi 8, and the vacuum acting on the slow fuel port 24 has extremely little influence on the vacuum in the outlet passage portion 25*c*. As mentioned above, since the vacuum in the outlet passage portion 25*c* is changed depending upon the vacuum in the venturi portion 8, and the level of the vacuum in the venturi portion 8 is maintained approximately constant in the variable venturi-type carburetor as illustrated in the FIGURE, the level of vacuum in the outlet passage portion 25*c* is maintained approxiately constant independent of the degree of opening of the throttle valve 6. Consequently, the amount of fuel flowing into the outlet passage portion 25*c* via the second slow fuel jet 29 is maintained approximately constant independent of the degree of opening of the throttle valve 6, and thus the amount of fuel fed into the intake passage 2 from the slow fuel port 24 is also maintained approximately constant, independent of the degree of opening of the throttle valve 6. Consequently, if the throttle valve 6 is abruptly opened in order to accelerate the engine, there is no danger that the amount of fuel fed from the slow fuel port 24 is reduced. Therefore, since the fuel mixture fed into the cylinder of the engine does not become lean, it is possible to obtain excellent engine acceleration and prevent exhaust emission quality from deteriorating. In addition, since air collects in the intake passage 2 at a region located downstream of and near the raised wall 31, if the jet 30 is arranged downstream of but near the raised wall 31 as illustrated in the FIGURE, a static vacuum acts on the jet 30, and a dynamic vacuum does not act on the jet 30. Consequently, since a vacuum of an approximately constant level continuously acts on the jet 30, the vacuum in the outlet passage portion 25*c* can be continuously maintained at an approximately constant level.

According to the present invention, since fuel is fed into the intake passage from the slow fuel port at the time of idling, it is possible to obtain stable engine idling. In addition, if the throttle valve is abruptly opened, and thus the level of vacuum acting on the slow fuel port becomes small, since the amount of fuel fed from the slow fuel port is not reduced, it is possible to obtain good engine acceleration and prevent exhaust emission quality from deteriorating.

While the invention has been described with reference to a specific embodiment chosen for purposes of illustration, it should be apparent that numerous modifications could be made thereto by those skilled in the art without departing from the basic concept and scope of the invention.

We claim:

1. A variable venturi-type carburetor comprising:

an intake passage formed in the carburetor and having an inner wall;

a suction piston transversely movable in said intake passage in response to a change in the amount of air flowing within said intake passage, said suction piston having a tip face which defines a venturi portion in said intake passage;

a throttle valve arranged in said intake passage at a position downstream of said suction piston;

a main fuel passage transversely extending to and opening into said intake passage;

a metering jet arranged in said main fuel passage;

a needle fixed onto the tip face of said suction piston and extending through said main fuel passage and said metering jet;

a slow fuel port formed on the inner wall of said intake passage and opening into said intake passage downstream of said throttle valve;

a slow fuel passage interconnecting said slow fuel port with said main fuel passage upstream of said metering jet;

a first fuel metering jet aranged in said slow fuel passage; and a vacuum control jet connecting said venturi portion to said slow fuel passage between said slow fuel port and said first fuel metering jet.

2. A variable venturi-type carburetor according to claim 1, wherein said vacuum control jet has an opening area larger than that of said slow fuel port.

3. A variable venturi-type carburetor according to claim 2, wherein said slow fuel port has an opening area larger than that of said first fuel metering jet.

4. A variable venturi-type carburetor according to claim 1, wherein a raised wall is formed on the inner wall of said intake passage at a position opposite to said suction piston and at a position located adjacent to and upstream of said suction piston, the tip face of said suction piston having an upstream end portion which cooperates with said raised wall for restricting the air flowing into said venturi portion.

5. A variable venturi-type carburetor according to claim 4, wherein said vacuum control jet is arranged to open into said venturi portion at a position located downstream of but near said raised wall.

6. A variable venturi-type carburetor according to claim 1, wherein said carburetor comprises a second fuel metering jet arranged in said slow fuel passage located between said slow fuel port and said first fuel metering jet, and an air bleed passage connected to said slow fuel passage located between said first fuel metering jet and said second fuel metering jet, said vacuum control jet opening into said slow fuel passage between said slow fuel port and said second fuel metering jet.

7. A variable venturi-type carburetor according to claim 6, wherein said second fuel metering jet has an opening area smaller than that of said vacuum control jet, but larger than that of said slow fuel port.

8. A variable venturi-type carburetor according to claim 6, wherein said slow fuel passage comprises a vertically extending inlet passage portion connected to said main fuel passage, a vertically extending outlet passage portion connected to said slow fuel port, and a horizontally extending intermediate passage portion arranged between said inlet passage portion and said outlet passage portion, said first fuel metering jet arranged in said inlet passage portion, said second fuel metering jet arranged in said intermediate passage portion.

9. A variable venturi-type carburetor according to claim 8, wherein said vacuum control jet opens into the connection portion of said outlet passage portion and said intermediate passage portion.

10. A variable venturi-type carburetor according to claim 8, wherein said air bleed passage is connected to the connecting portion of said inlet passage portion and said intermediate passage portion.

* * * * *